US007680588B2

(12) United States Patent
Tsukamoto

(10) Patent No.: US 7,680,588 B2
(45) Date of Patent: Mar. 16, 2010

(54) TRAFFIC INFORMATION MANAGEMENT SYSTEM

(75) Inventor: Akira Tsukamoto, Kariya (JP)

(73) Assignee: DENSO CORPORATION, Kariya (JP)

( * ) Notice: Subject to any disclaimer, the term of this patent is extended or adjusted under 35 U.S.C. 154(b) by 581 days.

(21) Appl. No.: 11/712,542

(22) Filed: Mar. 1, 2007

(65) Prior Publication Data

US 2007/0225894 A1 Sep. 27, 2007

(30) Foreign Application Priority Data

Mar. 27, 2006 (JP) ..... 2006-085401

(51) Int. Cl.
*G08G 1/00* (2006.01)

(52) U.S. Cl. ..... 701/117

(58) Field of Classification Search ..... 701/117–119; 340/928; 348/148–149
See application file for complete search history.

(56) References Cited

U.S. PATENT DOCUMENTS 6,546,330 B2 4/2003 Fushiki et al.
6,721,650 B2 4/2004 Fushiki et al.
6,781,125 B2 8/2004 Tokuda et al.
7,328,101 B2 * 2/2008 Ishikawa et al. ..... 701/209
7,355,528 B2 * 4/2008 Yamane et al. ..... 340/995.13
2001/0029425 A1 * 10/2001 Myr ..... 701/200
2004/0167710 A1 8/2004 Fushiki et al.
2008/0082251 A1 * 4/2008 Ishikawa et al. ..... 701/118
2008/0091339 A1 * 4/2008 Nagase et al. ..... 701/200
2009/0248286 A1 * 10/2009 Nagase et al. ..... 701/118

FOREIGN PATENT DOCUMENTS

JP A-2004-62514 2/2004

* cited by examiner

*Primary Examiner*—Yonel Beaulieu
(74) *Attorney, Agent, or Firm*—Posz Law Group, PLC

(57) ABSTRACT

A management center analyzes probe information uploaded from an in-vehicle terminal mounted in each of multiple probe cars to thereby generate road traffic information allowing specification of a unit road segment in a congested state. The generated road traffic information is transmitted via a broadcasting station and terrestrial digital broadcasting. Each in-vehicle terminal includes a navigation device. The navigation device determines traffic congestion state relative to multiple unit road segments successively in accordance to traveling of the relevant probe car. Only when confirming a predetermined difference relative to each unit road segment between the determined traffic congestion state and the traffic congestion state indicated in the road traffic information received from the management center, the navigation device uploads to the management center the probe information collected with respect to the corresponding unit road segment by using a mobile communications terminal.

11 Claims, 4 Drawing Sheets

TRAFFIC INFORMATION MANAGEMENT SYSTEM

CROSS REFERENCE TO RELATED APPLICATION

This application is based on and incorporates herein by reference Japanese Patent Application No. 200685401 filed on Mar. 27, 2006.

FIELD OF THE INVENTION

The present invention relates to a traffic information management system generating road traffic information to specify a road state using probe information from probe cars.

BACKGROUND OF THE INVENTION

A traffic information management system such as a probe car system (also called a probing car data system) has been recently developed which allows vehicles traveling on open roads as a probing sensor to collect information on road traffic or traffic flow. This system includes a management center to collect probe information including a current position, a speed, and sampling time of each probe car via a communications means. The management center analyzes the collected probe information to thereby generate road traffic information on road states (e.g., congested, frozen, or snowed state) for providing to drivers.

Patent document 1 describes an example of the probe car system. A probe car has a terminal, which periodically records positional and temporal information on areas, where the probe car travels, and uploads the recorded information as probe information to a management center, at periodic intervals or at a predetermined time such as a time when a congested state is detected. The management center stores the probe information uploaded and detects a congested state based on the current probe information and previous probe information. The management center then generates congestion information to be provided by referring to the detected results and map data.

Patent document 1: JP-2002-251698 A (U.S. Pat. No. 6,546,330 B2)

In such a probe car system, it is preferable that probe information is uploaded from each probe car to the center in a real-time basis. To that end, each probe car typically uploads the periodically recorded probe information at periodic intervals and at a specified time such as a time when a congested state is detected. As a result, the data volume uploaded from multiple probe cars inevitably becomes large, which results in significant increase in a load of the management center. For instance, data in the probe car system are uploaded using a mobile communications network operated by a wireless communications service company, so costs for uploading the data cannot be ignored. Thus, such a probe car system using the mobile communications network is not easily established as a business model.

SUMMARY OF THE INVENTION

It is an object of the present invention to provide a traffic information management system, which generates road traffic information while decreasing total data volume uploaded from probe cars without degrading an accuracy in the generated road traffic information.

According to an aspect of the present invention, a traffic information management system is provided as follows. The system includes a plurality of probe cars and a center. Each probe car has an in-vehicle terminal for collecting probe information including a current position and a speed of the each probe car. The in-vehicle terminal includes a transmitter configured to upload the collected probe information and a receiver configured to receive information broadcasted by a broadcasting system. The center is configured to communicate with the each probe car to receive the probe information transmitted from the in-vehicle terminal of the each probe car, generate road traffic information for specifying a road state by analyzing the received probe information, and transmit the generated road traffic information to the each probe car via the broadcasting system. The in-vehicle terminal further includes a determining unit and a communications control unit. The determining unit is configured to determine a road state, with respect to each unit road segment included in a plurality of unit road segments traveled by the each probe car, successively in accordance with traveling of the each probe car. The communications control unit is configured to allow the transmitter to transmit, to the center, probe information collected in the each unit road segment, only when a predetermined difference is present in the each unit road segment between (i) the determined road state and (ii) a road state indicated by the traffic information, which is received by the receiver via the broadcasting system.

According to another aspect of the present invention, a traffic information management system is provided as follows. The system includes a plurality of probe cars and a center. Each probe car has an in-vehicle terminal for collecting probe information including a current position and a speed of the each probe car. The center is configured to collect the probe information from the probe cars, generate road traffic information for specifying a road state by analyzing the collected probe information, and provide the road traffic information to the probe cars. The system further includes a first and second wireless data communications systems. The first wireless data communications system performs a data communications between the in-vehicle terminal and the center using a cell phone network. The second wireless data communications system performs a data communications from the center to the in-vehicle terminal using a broadcasting means, via which the in-vehicle terminal receives the road traffic information from the center. The in-vehicle terminal further includes a determining unit and a communications control unit. The determining unit is configured to determine a road state, with respect to each unit road segment included in a plurality of unit road segments traveled by the each probe car, successively in accordance with traveling of the each probe car. The communications control unit is configured to allow the first wireless data communications system to transmit, to the center, probe information collected in the each unit road segment, only when a predetermined difference is present in the each unit road segment between (i) the determined road state and (ii) a road state indicated by the traffic information received from the center.

BRIEF DESCRIPTION OF THE DRAWINGS

The above and other objects, features, and advantages of the present invention will become more apparent from the following detailed description made with reference to the accompanying drawings. In the drawings.

DETAILED DESCRIPTION OF THE PREFERRED EMBODIMENTS

Figure 1:
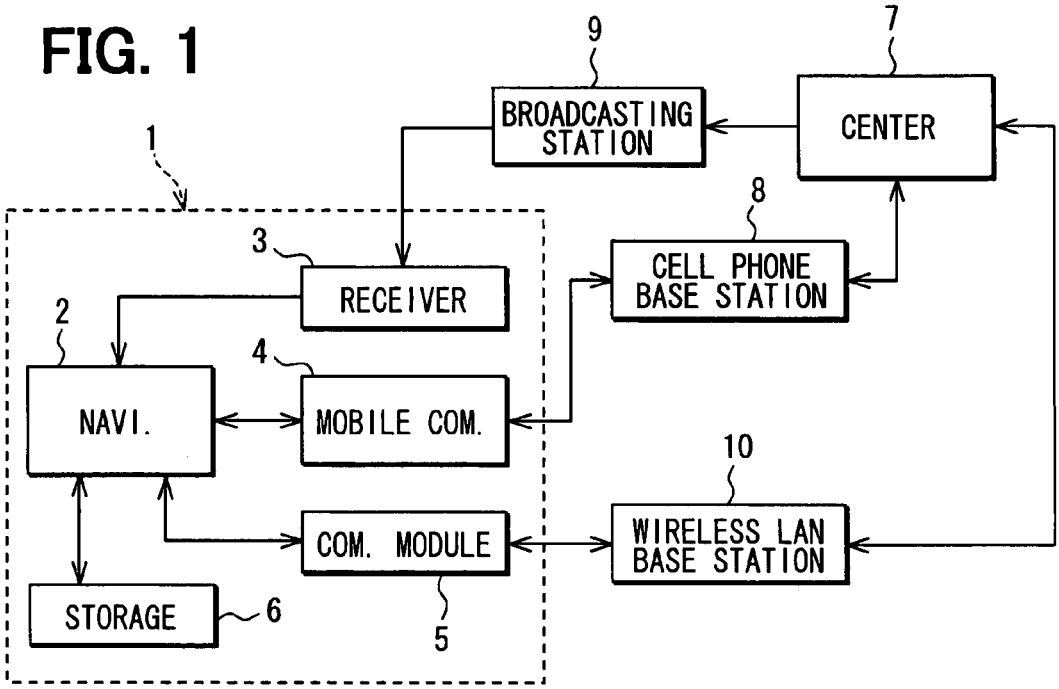
FIG. 1 is a functional block diagram illustrating an overall structure of a system of an embodiment according to the present invention.

As an embodiment according to the present invention, a traffic information management system configured to be a probe car system will be explained below. An overall structure of the system is illustrated in FIG. 1 using a functional block diagram. The system includes an in-vehicle terminal 1 mounted in each probe car of multiple probe cars (not shown). The in-vehicle terminal 1 includes a navigation device 2 as a main component, and other peripheral components pertinent to the navigation device 2. The navigation device 2 is configured to determine road states or control a data communications. The peripheral components include (i) a broadcast receiver 3 for receiving digital terrestrial broadcasting and FM text broadcasting, (ii) a mobile communications terminal 4 such as a cell phone, (iii) a wireless communications module 5 for wireless LAN, and (iv) a storage device 6 including rewritable non-volatile memory such as flash memory.

The navigation device 2 includes a probe data collection function for collecting probe information in addition to a known navigation function. For instance, the navigation device 2 mounted in a subject vehicle as a probe car receives a variety of vehicle travel information such as a speed signal from a speed sensor provided in the subject vehicle, and a signal indicating operating states of a brake system or ABS (Antilock Brake System). In other words, the navigation device 2 has a data collection function to collect probe information including the vehicle travel information and vehicle position information indicating a current position of the vehicle, which is obtained by the own navigation function.

Further, the navigation device 2 has (i) an upload function to selectively the collected probe information to a management center 7 via the mobile communications terminal 4, (ii) a congestion determination function to determine a congestion state in a road that the subject vehicle travels, and (iii) a travel record storing function to successively store and accumulate travel record information of the subject vehicle.

This travel record information is accumulated with respect to each unit road segment included in routes, from start points to arrival points, traveled or undergone by the subject vehicle. Of each unit road segment, the travel record information includes longitude and latitude information for specifying the unit road segment, a road link number indicating a road type, a date and hour of travel, and a travel speed. The longitude and latitude information is pertinent to a start point and an end point of the unit road segment. The road type is, e.g., an expressway and an open road.

Further, the above unit road segment may be a road link, which can be indicated by road map data. This allows the travel record information to only include a road link number, a date and hour of travel, and a travel speed.

The storage device 6 stores a travel speed database to include segment travel data indicating individual average travel speeds Va with respect to multiple unit road segments. This travel speed database may be stored in the navigation device 2 as default data, e.g., which is imported to the navigation device 2 using a storage medium, such as a CD-ROM, DVD-ROM, or memory card. The database is preferably updated accordingly based on changes in road states. Thus, in this embodiment, the management center 7 successively computes average travel speeds Va to thereby generate and update the travel speed database.

The management center 7 collects travel record information stored and accumulated in each probe car at predetermined time points to accumulate them; then, the management center 7 statistically processes the accumulated information to thereby compute an average travel speed Va with respect to each of various temporal travel types of each unit road segment. For instance, the temporal travel types are classified based on a day of the week, a public holiday, a date and hour, or a time zone. Here, when a unit road segment includes different road types, e.g., an open road under an expressway, multiple average travel speeds are computed with respect to multiple road types, respectively. The management center 7 generates a travel speed database to record, as segment travel data, the above computed average travel speeds Va, longitude and latitude information, and road types. The segment travel data are further classified with respect to a day of the week, a public holiday, a date and hour, and a time zone.

The travel speed database stored in the center 7 is exported or transported to the storage device 6 in an in-vehicle terminal 1 of each probe car at appropriate time points. This transporting need not be performed in a real-time basis. In other words, the data transfer can be made in a batch-wise basis. Therefore, data transfer is made, e.g., via communications means needing no communications charge (for each data transfer). For instance, data transfer is made by a short range wireless data communications means using a wireless LAN base station 10 located in a local service station (e.g., gas station), or a certain communications means using a communications terminal for personal computer located in a service station (e.g., car dealer). The communications terminal for personal computer includes not only a wireless communications means such as a wireless LAN and the Bluetooth (trademark), but also a wired communications means such as USB (Universal Serial Bus). Furthermore, the data transfer can be made using a storage medium using a storage medium, such as a CD-ROM, DVD-ROM, or memory card with an assumption that each probe car is provided with an appropriate reader for that storage medium.

Further, the collection procedure for the management center 7 to collect the above-mentioned travel record information from each probe car need not be performed in a real-time basis, too; therefore, similarly, the collection procedure uses communications means needing no communications charge for each data transfer. The management center 7 is a core of the probe car system to compute an averaged travel speed at a current time as real time data relative to a unit road segment by analyzing probe information uploaded from the terminal 1 of each probe car via a mobile communications terminal 4 and cell phone base station 8. This unit road segment-specific real-time average travel speed Vx is then compared with the above-mentioned average travel speed Va. When $Vx<(Va-\alpha$ (threshold value)) is satisfied, amendment travel speed information (i.e., amendment travel information or road traffic information) is generated. The amendment travel speed information includes a difference $Vr(=Va-Vx)$ and longitude and latitude information specifying the corresponding unit road segment. The threshold value $\alpha$ is provided to disregard a minor difference between Vx and Va. The minor difference is regarded as indicating that the relevant unit road segment is determined to be not in a congested state.

The management center 7 transmits the generated amendment travel speed information in a real-time basis using a broadcasting station 9 (i.e., a broadcasting system or broadcasting means) via terrestrial digital broadcasting and FM text broadcasting.

Further, the management center 7 can perform a data communications with the communications module 5 in each in-vehicle terminal 1 via one of multiple wireless LAN base stations 10 located in local service stations, e.g., gas stations.

Next, operations in the navigation device 2 will be explained with reference to FIGS. 2 to 4.

Figure 2:
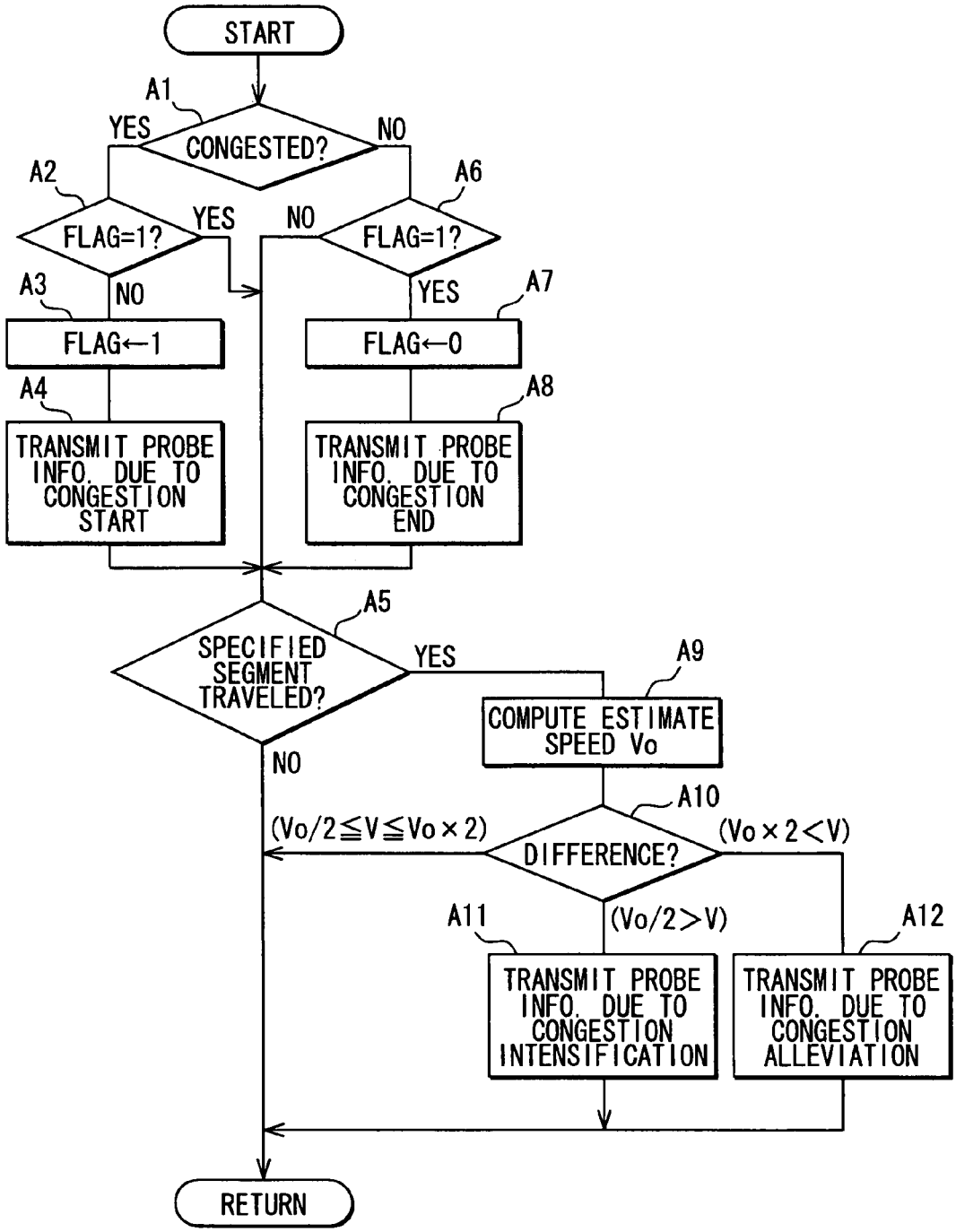

FIG. 2 illustrates a probe information processing routine to function as a probe car. FIG. 3 illustrates a broadcast receiving routine as an interrupt routine. FIG. 4 illustrates a travel record transmitting routine.

Figure 3:
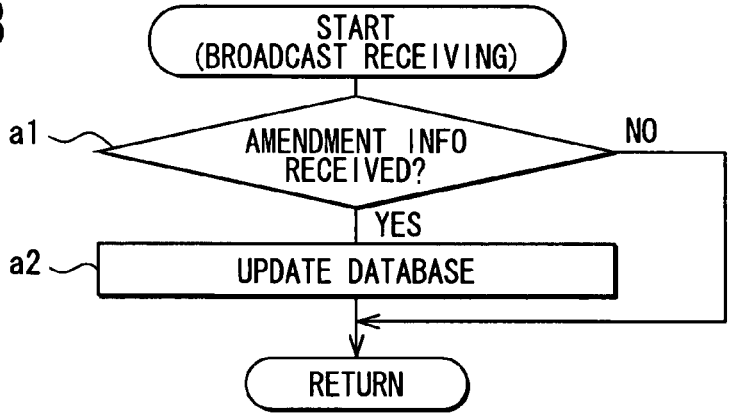
FIGS. 2, 3, and 4 are flowchart diagrams illustrating operations in a navigation device.

In the broadcast receiving routine in FIG. 3, it is determined whether amendment travel speed information is received by the receiver 3 (Step a1). When it is determined to be received, Step a2 is performed for updating the database using the received information. When it is determined to be not received, the sequence returns.

Figure 4:
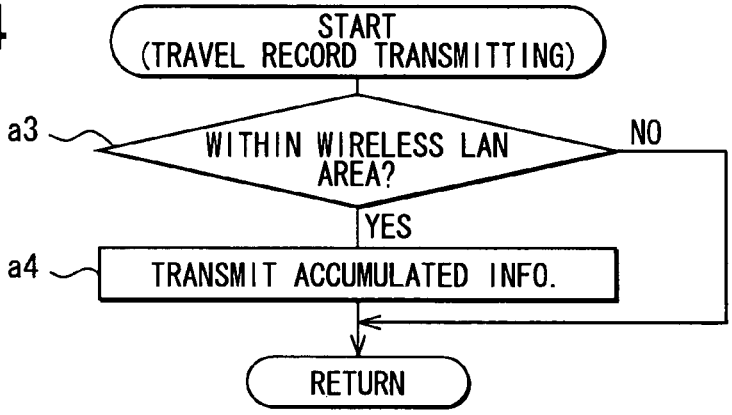

In the travel record transmitting routine in FIG. 4, it is determined whether the subject vehicle is located within a communications area covered by the wireless LAN base station 10 (Step a3). When it is determined to be within the area, Step a4 is performed for transmitting the accumulated travel record information to the center 7 via the communications module 5 and the wireless LAN base station 10. When it is determined to be not within the area (i.e., when a carrier signal is not received), the sequence returns.

Further, transfer of the travel speed database from the center 7 to the storage device 6 in the subject vehicle may be made when the subject vehicle enters within a communications area by the wireless LAN base station 10. In this case, the data transfer is naturally made only when the version of the travel speed database stored in the storage device 6 is older than that of the travel speed database in the center 7.

In the probe information processing routine in FIG. 2, it is determined whether a road that the subject vehicle is currently traveling is in a congested state (Step A1). Whether a congested state arises or not is determined, e.g., based on an average travel speed V of the subject vehicle obtained from the speed sensor. The following congestion determination methods are used at the same time.

(1) Obtaining an average travel speed Va relative to a currently traveled unit road segment and corresponding to a temporal travel type (e.g., a day of the week, a holiday, a date, a time zone) from the travel speed database stored in the storage device 6; computing an average travel speed V when traveling the unit road segment is completed; and when $V<Va/3$ is satisfied, determining that the unit road segment is in a congested state.

(2) Storing a legal speed relative to a road in the road map data for the navigation device 2; and when an average travel speed of the subject vehicle continues to be less than a half of the legal speed for a period equal to or greater than a predetermined time period, determining that the unit road segment is in a congested state.

(3) Obtaining road type-specific data specific to a road type such as expressway and residential road stored in the road map data for the navigation device 2; and determining that the unit road segment is in a congested state based on the obtained road type-specific data, an average travel speed, and a brake operation state. For instance, when traveling an expressway, an average travel speed for a predetermined time period is less than a predetermined speed (e.g., less than 30 km/h), a congested state is determined. When traveling a residential road, a stop and a start are repeated more than a predetermined count for a predetermined time period, a congested state is determined.

The congestion determination method may be other than the above three methods (1), (2), (3). For instance, it can be a method to analyze an image of a scenery ahead of the subject vehicle photographed by an in-vehicle camera; further, it can be a method to analyze a relationship between a travel speed and a brake operation state.

When a corresponding certain unit road segment is determined in a congested state at Step A1, it is then determined whether a congestion flag is set to "1" or not (Step A2). This congestion flag indicates a congestion state of an adjacent unit road segment preceding the certain unit road segment, which was determined to be in a congested state at Step A1. The flag "1" means a congested state, while the flag "0" means a not-congested state. When the determination at Step A2 is affirmed, it is assumed that the congested state continues from the adjacent unit road segment to the latest traveled unit road segment. When the determination at Step A2 is negated, it is assumed that the congested state newly starts from the latest traveled unit road segment.

When the determination at Step A2 is negated (i.e., when the flag is set to "0"), the flag is set to "1" (Step A3), and probe information indicating a congestion start is transmitted to the management center 7 via the mobile communications terminal 4 and cell phone base station 8 in a real-time basis (Step A4). The sequence then proceeds to Step A5. When the determination at Step A2 is affirmed (i.e., when the flag is set to "1"), Step A3 and Step A4 are skipped over and Step S5 is performed.

In other words, when a road state relative to a congestion is changed at a border between adjacent unit road segments, i.e., when the congested state determined at a certain unit road segment starts from the certain unit road segment itself, the probe information is uploaded. In contrast, when a road state relative to a congestion is not changed at a border between adjacent unit road segments, i.e., when the congested state determined at a certain unit road segment is continued from the adjacent unit road segment preceding the certain unit road segment, the probe information is not uploaded.

A data collection period (called "congestion start information collection period") of the probe information due to congestion start transmitted at Step A4 is set to cover a range from a certain unit road segment, from which the congestion starts, to a unit road segment preceding the certain unit road segment by one segment or more than one segment as needed. Information collected in the congestion start information collection period is as follows.

The probe information due to congestion start includes at least (i) a road link number(s) corresponding to the collection period, (ii) start point passing time information indicating a time when the subject vehicle passes through a start point of the collection period, (iii) start point information indicating, of the start point, longitude/latitude, traveling direction, and travel speed, (iv) difference information indicating a difference from individual initial values with respect to each minimum unit segment (e.g., 10 meters) (difference of the traveling direction and travel speed may be zero), and (v) end point information (longitude/latitude information). The difference information may be collected not only at a time point when a predetermined distance traveled by the subject vehicle, but also at a start point or stop point (so called short stop or short trip) of the subject vehicle.

The probe information due to congestion start may further include (i) information indicating whether a route guide function is performed in the navigation device 2 and (ii) information on operation states relative to vehicle travel, e.g., a right/left turn operation (a direction indicator is turned on more than a predetermined time period), a hazard switch operation, and whether a passenger is present or not when the subject vehicle is a taxi. Here, the information on the operation states is used in the management center 7 for data cleansing. For instance, when the hazard switch's operation state indicates that the vehicle stops, the corresponding data is eliminated from further processing.

In contrast, when the certain unit road segment is determined to be not in a congested state at Step A1, it is then determined whether the congestion flag is set to "1" or not (Step A6). When the determination at Step A6 is negated, it is assumed that the congested state does not take place from the adjacent unit road segment to the latest traveled unit road segment. When the determination at Step A2 is affirmed, it is assumed that the congested state ends within the preceding adjacent unit road segment.

When the determination at Step A6 is affirmed (i.e., when the flag is set to "1"), the flag is set to "0" (Step A7) and probe information indicating a congestion end is transmitted to the management center 7 via the mobile communications terminal 4 and cell phone base station 8 in a real-time basis (Step A8). The sequence then proceeds to Step A5. When the determination at Step A6 is negated (i.e., when the flag is set to "0"), Step A7 and Step A8 are skipped over and Step S5 is performed.

In other words, when a road state relative to a congestion is changed at a border between adjacent unit road segments, i.e., when the congested state determined at the preceding adjacent unit road segment ends in the certain unit road segment itself, the probe information due to congestion end is uploaded. In contrast, when a road state relative to a congestion is not changed at a border between adjacent unit road segments, i.e., when the not-congested state determined at a certain unit road segment is continued from the adjacent unit road segment preceding the certain unit road segment, the probe information is not uploaded.

The data collection period (called "congestion end information collection period") of the probe information due to congestion end transmitted at Step A8 is set to cover a range from a preceding unit road segment, from which the congestion starts, to the certain unit road segment in which the congestion ends. Information collected in the congestion end information collection period is similar to those in the congestion start information collection period.

At Step A5, it is determined whether the certain unit road segment is a segment (called "specified unit road segment) specified by the amendment travel speed information stored or updated in the broadcast receiving routine in FIG. 3. When this determination is negated, i.e., the certain unit road segment, which is the latest traveled road, is not related to the amendment travel speed information, the sequence returns.

In contrast, when this determination is affirmed, Step A9 is performed for computing an estimate travel speed Vo. At Step A9, an average travel speed Va relative to a currently traveled unit road segment is obtained with respect to a temporal travel type (e.g., a day of the week, a holiday, a date, a time zone) from the travel speed database stored in the storage device 6; the amendment travel speed information Vr corresponding to the specified unit road segment is obtained from the amendment travel speed information stored or updated in the broadcast receiving routine; then, an estimate travel speed Vo is computed by subtracting the amendment travel speed Vr from the average travel speed Va (i.e., $Vo=Va-Vr$).

After performing Step A9, a difference is determined between the estimate travel speed Vo and an actual average travel speed V of the subject vehicle in the corresponding specified unit road segment (Step S10).

In other words, when a congested state is intensified with respect to the specified unit road segment, the in-vehicle terminal 1 transmits probe information due to congestion intensification to the management center 7 via the mobile communications terminal 4 and the cell phone base station 8 in a real-time basis (Step A11). The congestion intensification is determined when the average travel speed V becomes slower than the estimate travel speed Vo by more than a predetermined threshold, e.g., when $V<Vo/2$. After Step A11 is completed, the sequence returns to Step A1.

The data collection period (called "congestion intensification information collection period") of the probe information due to congestion intensification transmitted at Step A11 is set to the corresponding specified unit road segment. Information collected in the congestion intensification information collection period is similar to those in the congestion start information collection period (see Step A4).

In contrast, when a congested state is alleviated with respect to the specified unit road segment, the in-vehicle terminal 1 transmits probe information due to congestion alleviation to the management center 7 via the mobile communications terminal 4 and the cell phone base station 8 in a real-time basis (Step A12). The congestion alleviation is determined when the average travel speed V becomes faster than the estimate travel speed Vo by more than a predetermined threshold value, e.g., when $V>Vo\times2$. After Step A12 is completed, the sequence returns to Step A1. The data collection period (called "congestion alleviation information collection period") of the probe information due to congestion alleviation transmitted at Step A12 is set to the corresponding specified unit road segment. Information collected in the congestion alleviation information collection period is similar to those in the congestion intensification information collection period.

In contrast, when the difference determination at Step A10 is that $Vo/2\leqq V\leqq Vo\times2$, the sequence returns to Step A1.

Next, operations in the management center 7 will be explained with reference to FIGS. 5 and 6 about a signal processing routine when the above probe information is received.

Figure 5:
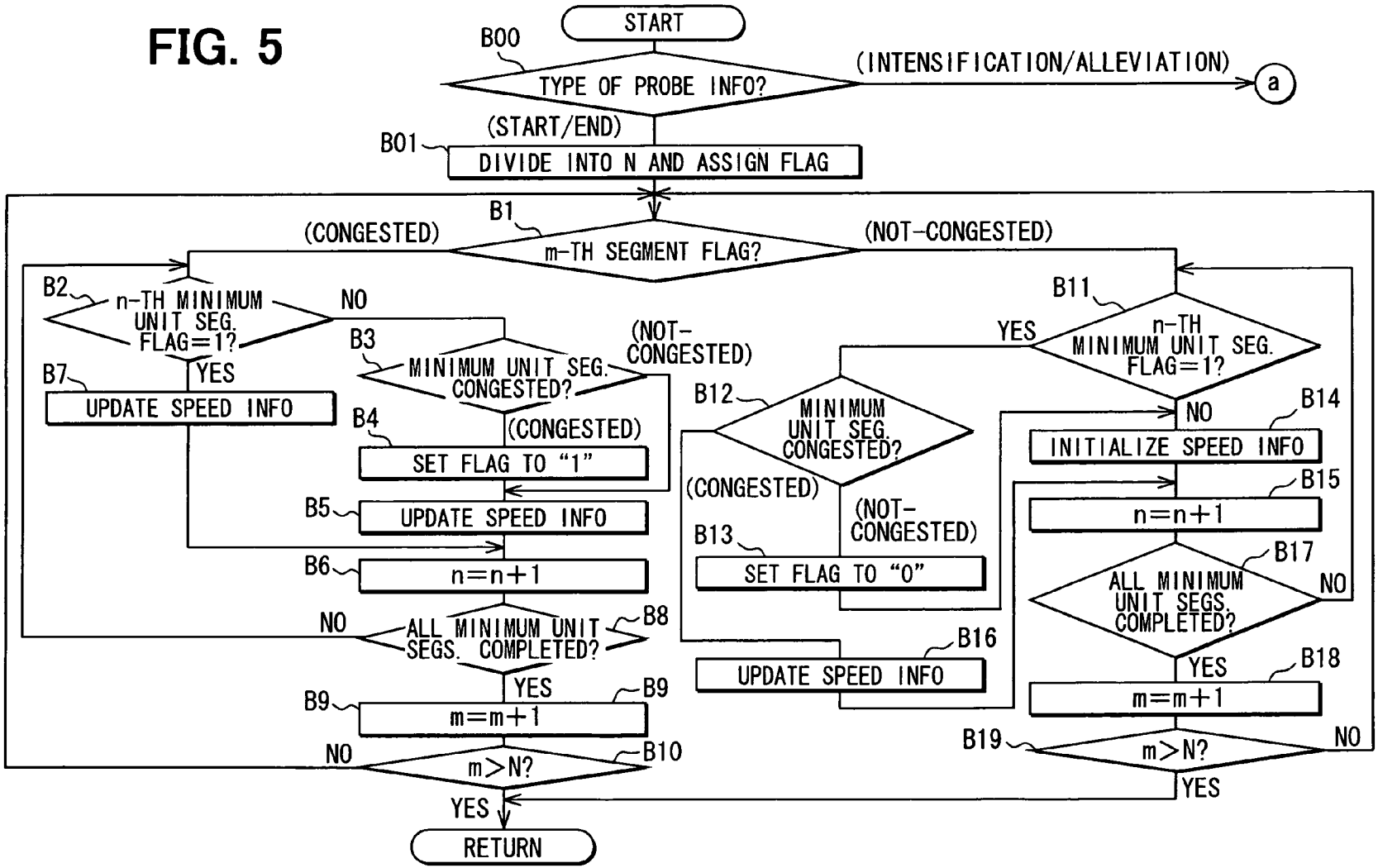
FIGS. 5 and 6 are flowchart diagrams illustrating operations in a management center.

In FIG. 5, at Step B00, a type of the received probe information is determined. When it is due to congestion intensification or congestion alleviation, the sequence proceeds to Step C1 in FIG. 6. In contrast, when it is due to congestion start or congestion end, Step B01 is performed. At Step B01, congestion flags are appropriately assigned to a congested period and a not-congested period. For instance, a congested period is defined as a period to the segment indicated by the currently received latest probe information due to congestion end from the segment indicated by the previously received probe information due to congestion start. A not-congested period is defined as a period to the segment indicated by the currently received latest probe information due to congestion start from the segment indicated by the previously received probe information due to congestion end. Both the periods are individually divided into N segments and each segment is assigned a segment congestion flag.

Then, a type of the segment congestion flag of the m-th segment (m: natural number from 1 to N) is determined (Step B1). When the type is determined to indicate a congested state, it is determined whether the n-th minimum unit segment (n: natural number from 1) is assigned congestion flag "1" (Step B2). The congestion flag "1" is assigned when the minimum unit segment is in a congested state.

When the determination at Step B2 is negated, it is then determined whether the n-th minimum unit segment is in a congested state by using information (included in the received probe information) indicating the vehicle travel speed thereof (Step B3). The determination at Step B3 is performed using the same method as the above-mentioned congestion determination methods (1) to (3) or other appropriate method.

When the n-th minimum unit segment is determined to be in a congested state at Step B3, the corresponding congestion flag is set to "1" (Step B4). Further, the vehicle travel speed of the n-th minimum unit segment is updated (Step B5), and the variation n is incremented by one "1" (Step B6). When the n-th minimum unit segment is determined to be not in a congested state at Step B3, Step B4 is skipped over and Steps B5, B6 are sequentially performed.

In contrast, when the determination at Step B2 is affirmed, the vehicle travel speed of the n-th minimum unit segment is updated (Step B7), and the sequence proceeds to Step B6. After Step B6 is completed, it is determined whether data processing is completed with respect to all the minimum unit segments (Step B8). When data processing is not completed entirely, Step B2 and its subsequent steps are repeated.

In contrast, when the data processing is completed entirely, the variation m is incremented by one "1" (Step B9), and it is then determined whether m>N is satisfied (Step B10). When m≦N is satisfied, Step B1 and its subsequent steps are repeated. When m>N is satisfied, the sequence returns to the initial state.

When the type is determined to indicate not-congested state at Step B1, data processing is performed with respect to N segments included in the relevant probe information. In detail, it is determined whether the n-th minimum unit segment is assigned congestion flag "1" (Step B11). When the determination at Step B11 is affirmed, it is then determined whether the n-th minimum unit segment is in a congested state by using information (included in the received probe information) indicating the vehicle travel speed thereof (Step B12).

When the n-th minimum unit segment is determined to be in a not-congested state at Step B12, the corresponding congestion flag is reset to "0" (Step B13). Further, the speed information of the n-th minimum unit segment is initialized (Step B5) (i.e., an average travel speed Va of the unit road segment including the relevant minimum unit segment is substituted or used to update), and the variation n is incremented by one "1" (Step B15). When the n-th minimum unit segment is determined to be in a congested state at Step B12, the vehicle travel speed of the n-th minimum unit segment is updated (Step B16), and the variation n is incremented by one "1" (Step B15). After Step B15 is completed, it is determined whether data processing is completed with respect to all the minimum unit segments (Step B17). When data processing is not completed entirely, Step B11 and its subsequent steps are repeated.

In contrast, when the data processing is completed entirely, the variation m is incremented by one "1" (Step B18), and it is then determined whether m>N is satisfied (Step B19). When m≦N is satisfied, Step B1 and its subsequent steps are repeated. When m>N is satisfied, the sequence returns to the initial state.

Figure 6:
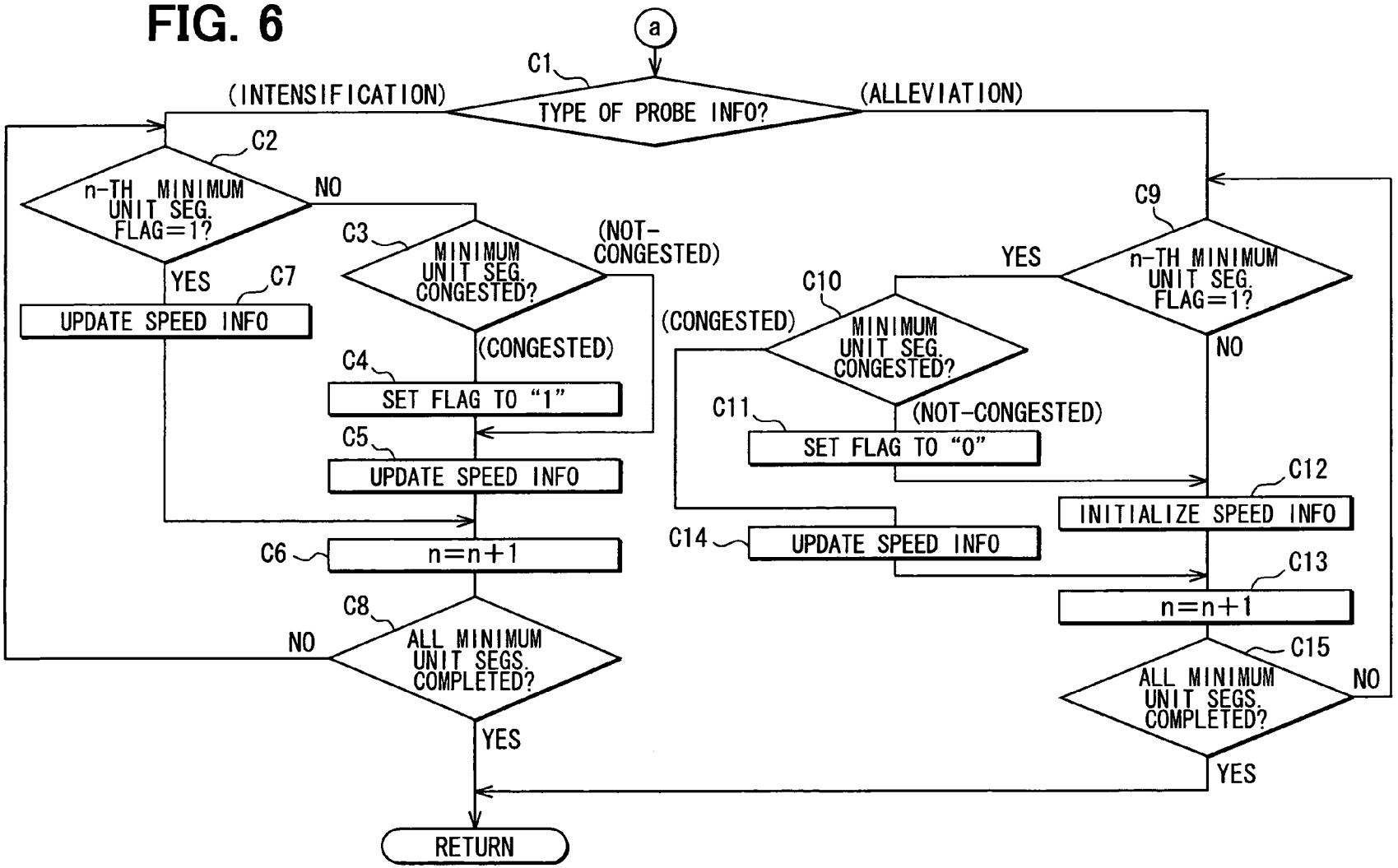

At above-mentioned Step B00, when the received probe information is due to congestion intensification or congestion alleviation, the sequence proceeds to Step C1 in FIG. 6, where a type of the received probe information is determined.

When it is due to congestion intensification, data processing is successively performed with respect to multiple minimum unit segments (e.g., every 10 meters). In detail, it is determined whether a congestion flag of the n-th minimum unit segment (n: natural number from "1") is "1" (Step C2).

When the determination at Step C2 is negated, it is then determined whether the n-th minimum unit segment is in a congested state by using information (included in the received probe information) indicating the vehicle travel speed thereof (Step C3). The determination at Step C3 is performed using the same method as the above-mentioned congestion determination methods (1) to (3) or other appropriate method.

When the n-th minimum unit segment is determined to be in a congested state at Step C3, the corresponding congestion flag is set to "1" (Step C4), the vehicle travel speed of the n-th minimum unit segment is updated (Step C5), and the variation n is incremented by one "1" (Step C6). When the n-th minimum unit segment is determined to be not in a congested state at Step C3, Step C4 is skipped over and Steps C5, C6 are sequentially performed.

In contrast, when the determination at Step C2 is affirmed, the vehicle travel speed of the n-th minimum unit segment is updated (Step C7), and the sequence proceeds to Step C6. After Step C6 is completed, it is determined whether data processing is completed with respect to all the minimum unit segments (Step C8). When data processing is not completed entirely, Step C2 and its subsequent steps are repeated.

At above-mentioned Step C1, when it is due to congestion alleviation, data processing is also sequentially performed with respect to multiple minimum unit segments. In detail, it is determined whether the n-th minimum unit segment is assigned congestion flag "1" (Step C9). When the determination at Step C9 is affirmed, it is then determined whether the n-th minimum unit segment is in a congested state by using information (included in the received probe information) indicating the vehicle travel speed thereof (Step C10).

When the n-th minimum unit segment is determined to be in a not-congested state at Step C10, the corresponding congestion flag is reset to "0" (Step C11), the speed information of the n-th minimum unit segment is initialized (Step C12) (i.e., an average travel speed Va of the unit road segment including the relevant minimum unit segment is substituted or used to update), and the variation n is incremented by one "1" (Step C13). When the n-th minimum unit segment is determined to be in a congested state at Step C10, the vehicle travel speed of the n-th minimum unit segment is updated (Step C14), and the variation n is incremented by one "1" (Step C13).

After Step C13 is completed, it is determined whether data processing is completed with respect to all the minimum unit segments (Step C15). When data processing is not completed entirely, Step C9 and its subsequent steps are repeated.

The management center 7 computes a real-time average travel speed Vx relative to each unit road segment including the minimum unit segments based on the speed information relative to each minimum unit segment updated above. The center 7 generates the above mentioned amendment travel speed Vr based on comparison between the real-time average travel speed Vx and the average travel speed Va relative to the corresponding unit road segment.

As a result of the above operations, the following advantages can be obtained. The management center 7 generates, as congestion information specifying a congestion occurrence point, amendment travel speed information including an amendment travel speed Vr relative to each unit road segment and longitude and latitude information of the each unit road segment. The center 7 transmits the generated amendment travel speed information in a real-time basis from the broadcasting station 9 via terrestrial digital broadcasting and FM text broadcasting. As a result, each in-vehicle terminal 1 can instantly receive the transmitted amended travel speed information via the own receiver 3.

Each in-vehicle terminal 1 has the storage device 6 storing a travel speed database. The travel speed database stores segment travel data indicating average travel speeds Va relative to unit road segments. The navigation device 2 computes an estimate travel speed Vo of the subject vehicle relative to a unit road segment, where a congestion takes place, based on (i) the average travel speed Va indicated by the segment travel data in the travel speed database and (ii) the amendment travel speed Vr in the received amendment travel speed information. Further, the navigation device 2 uploads probe information due to congestion intensification or congestion alleviation, which is collected with respect to a unit road segment, to the management center 7 via the communications means only when a difference between the estimate travel speed Vo and the actual travel speed V exceeds a predetermined threshold value.

In other words, communications operation due to upload of the probe information from the in-vehicle terminal 1 to the management center 7 is performed only when a predetermined difference arises between the congestion state indicated by the received amendment travel speed information and the actual congestion state. Therefore, useless communications operation can be restricted, and the total data volume of the probe information transmitted can be decreased. Further, this helps prevent needless increase in loads in the management center 7 and significant increase in communications costs due to use of the mobile communications terminal 4. This can bring a business model into existence. When a congested state is solved in a certain unit road segment, the difference between the estimate travel speed Vo and the actual travel speed V falls within a predetermined threshold. The in-vehicle terminal 1 thereby uploads the latest collected probe information to the management center 7. This helps prevent degradation in accuracy of the congestion information generated in the management center 7.

Further, the segment travel data in the travel speed database of the storage device 6 is preferably updated successively; however, as it becomes old, it does not dramatically change. Therefore, it does not need real-time update. As a result, it can be practically updated using the low-cost wireless LAN or the like in a batch-wise basis without limited to the cell phone.

For instance, in the above embodiment, the in-vehicle terminal 1 successively stores and accumulates travel record information with respect to multiple unit road segments in the routes undergone by the subject vehicle. The travel record information includes vehicle travel speeds and information specifying the corresponding unit road segments. The management center 7 collects the accumulated travel record information stored in each of the multiple in-vehicle terminals 1 via wireless LAN base stations 10 located in local service stations in a batch-wise basis. The management center 7 then statistically processes the collected travel record information to thereby compute and accumulate segment travel data, which includes an average travel speed Va relative to each of the unit road segments. These accumulated segment travel data is transported to the storage device 6 in the in-vehicle terminal 1 of each of multiple probe cars at appropriate time points in a batch-wise basis. As a result, the segment travel data stored in the travel speed database can be kept more accurate and more easily maintained.

Further, only when a congestion state is changed at a border between adjacent unit road segments, the in-vehicle terminal 1 uploads probe information to the management center 7 via the mobile communications terminal 4 in a real-time basis. To that end, in cases where the subject vehicle successively travels multiple unit road segments, upload of probe information is not performed when the congestion state does not change between the adjacent unit road segments. This can help prevent increase in the total volume of the probe information transmitted from the probe car to the management center 7 in a real-time basis.

Further, the management center 7 records a congestion flag relative to a relevant minimum unit segment based on speed information or the like with respect to multiple minimum unit segments included in the probe information uploaded from the probe car. Therefore, a congestion occurrence point can be recognized in detail based on the congestion flag, which provides congestion information with a high reliability relating to the congestion occurrence point.

In this case, information indicating longitude/latitude, heading direction, and travel speed in the probe information uploaded from the probe car is differential data, which effectively decreases the data volume of the probe information.

(Modifications)

The management center 7 generates amendment travel speed information including an amendment travel speed Vr and transmits it via the broadcasting station 9. The amendment travel speed information may be replaced with amendment travel time information for amending a travel time in a unit road segment in a congested state. The storage device 6 stores segment travel data indicating an average travel speed Va relative to each unit road segment. The segment travel speed information may be replaced with segment travel data indicating a travel time relative to each unit road segment.

A road congestion is explained as an example of a road state indicated by road traffic information transmitted from the management center 7 via the broadcasting station 9. Another road state such as a frozen road state or snowed road state can be also included as an example. When the in-vehicle terminal 1 determines the frozen state or snowed state, output signals from the ABS (Antilock Brake System) may be used for determination.

A communications means for transporting the travel speed database constructed in the management center 7 to the storage device 6 of the in-vehicle terminal 1 or for collecting the travel record information accumulated in the probe car to the management center 7 can be constructed as a DSRC (Dedicated Short Range Communication). A transmission means or communications means for transmitting road traffic information from the management center 7 to the probe car can be achieved using a VICS (Vehicle Information and Communication System) receiver provided in the in-vehicle terminal 1.

Thus, the embodiment can include multiple communications methods for a data communications between each in-vehicle terminal 1 and a management center 7, i.e., a cell phone system, a broadcasting system, a short range communications system such as a wireless LAN or DSRC, or the like. Each system may change its cost charging system as needed. In this case, the system according to the above embodiment may easily change the flow of the data communications between the in-vehicle terminal 1 and the management center 7 to appropriately achieve the minimum communications charge in accordance with the change in the cost charging system. This allows this system to be practically established as a business model.

Each or any combination of processes, steps, or means explained in the above can be achieved as a software unit (e.g., subroutine) and/or a hardware unit (e.g., circuit or integrated circuit), including or not including a function of a related device; furthermore, the hardware unit can be constructed inside of a microcomputer.

Furthermore, the software unit or any combinations of multiple software units can be included in a software program, which can be contained in a computer-readable storage media or can be downloaded and installed in a computer via a communications network.

It will be obvious to those skilled in the art that various changes may be made in the above-described embodiments of the present invention. However, the scope of the present invention should be determined by the following claims.

What is claimed is:

1. A traffic information management system comprising:

a plurality of probe cars, each probe car having an in-vehicle terminal for collecting probe information including a current position and a speed of the each probe car, the in-vehicle terminal including a transmitter configured to upload the collected probe information and a receiver configured to receive information broadcasted by a broadcasting system; and a center configured to communicate with the each probe car to receive the probe information transmitted from the in-vehicle terminal of the each probe car, generate road traffic information for specifying a road state by analyzing the received probe information, and transmit the generated road traffic information to the each probe car via the broadcasting system, wherein the in-vehicle terminal further includes a determining unit configured to determine a road state, with respect to each unit road segment included in a plurality of unit road segments traveled by the each probe car, successively in accordance with traveling of the each probe car, and a communications control unit configured to allow the transmitter to transmit, to the center, probe information collected in the each unit road segment, only when a predetermined difference is present in the each unit road segment between (i) the determined road state and (ii) a road state indicated by the traffic information, which is received by the receiver via the broadcasting system.

2. The traffic management system of claim 1, wherein the center generates, as the road traffic information, amendment travel information used for amending at least one of a travel speed and a travel time in a unit road segment in a congested state, the in-vehicle terminal includes a storage unit for storing, with respect to the each unit road segment, first segment travel data indicating at least one of an average travel speed and an average travel time, the determining unit estimates a travel speed in the unit road segment in the congested state based on the stored first segment travel data and the received amendment travel information, and the communications control unit allows the transmitter to transmit probe information with respect to the unit road segment in the congested state to the center only when a difference exceeding a predetermined threshold value is present between (i) the estimated travel speed and (ii) an actual travel speed undergone by the vehicle.

3. The traffic management system of claim 2, further comprising:

a short range communications system provided in each of a plurality of local service stations for performing a short range data communications with the in-vehicle terminal, wherein the in-vehicle terminal successively accumulates, with respect to each unit road segment undergone by the each probe car, travel record information including (i) information specifying the each unit road segment and (ii) a travel speed undergone by the each probe car, the center collects the travel record information via the short range communications system and statistically processes the collected travel record information to compute and store second segment travel data indicating at least one of an average travel speed and an average travel time with respect to each unit road segment, and the first segment travel data stored in the storage unit in the in-vehicle terminal is constructed by transporting as needed the second segment travel data stored in the center.

4. The traffic management system of claim 1, wherein the communications control unit allows the transmitter to transmit, to the center, probe information to the center only when a difference at a border between adjacent unit road segments is present in road states determined by the determining unit.

5. A traffic information management system comprising:

a plurality of probe cars, each probe car having an in-vehicle terminal for collecting probe information including a current position and a speed of the each probe car;

a center configured to collect the probe information from the probe cars, generate road traffic information for specifying a road state by analyzing the collected probe information, and provide the road traffic information to the probe cars;

a first wireless data communications system for performing a data communications between the in-vehicle terminal and the center using a cell phone network; and a second wireless data communications system for performing a data communications from the center to the in-vehicle terminal using a broadcasting means, via which the in-vehicle terminal receives the road traffic information from the center, wherein the in-vehicle terminal further includes a determining unit configured to determine a road state, with respect to each unit road segment included in a plurality of unit road segments traveled by the each probe car, successively in accordance with traveling of the each probe car, and a communications control unit configured to allow the first wireless data communications system to transmit, to the center, probe information collected in the each unit road segment, only when a predetermined difference is present in the each unit road segment between (i) the determined road state and (ii) a road state indicated by the traffic information received from the center.

6. The traffic management system of claim 5, wherein the center generates, as the road traffic information, amendment travel information used for amending at least one of a travel speed and a travel time in a unit road segment in a congested state, the in-vehicle terminal includes a storage unit for storing, with respect to the each unit road segment, first segment travel data indicating at least one of an average travel speed and an average travel time, the determining unit estimates a travel speed in the unit road segment in the congested state based on the stored first segment travel data and the received amendment travel information, and the communications control unit allows the first wireless data communications system to transmit probe information with respect to the unit road segment in the congested state to the center only when a difference exceeding a predetermined threshold value is present between (i) the estimated travel speed and (ii) an actual travel speed undergone by the vehicle.

7. The traffic information management system of claim 5, further comprising:

a third wireless data communications system for performing a data communications between the in-vehicle terminal and the center using a plurality of short range communications stations for performing a short range data communications with the in-vehicle terminal, wherein the in-vehicle terminal successively accumulates, with respect to each unit road segment undergone by the each probe car, travel record information including (i) information specifying the each unit road segment and (ii) a travel speed undergone by the each probe car, the center collects the travel record information via the short range communications stations and statistically processes the collected travel record information from the plurality of probe cars to compute and store segment travel data indicating at least one of an average travel speed and an average travel time with respect to each unit road segment, and the segment travel data stored in the center are transported and stored to the in-vehicle terminal via at least one of (i) the third wireless data communications system and (ii) another data communications system excluding the first, the second, and the third wireless data communications systems.

8. The traffic information management system of claim 5, wherein the first wireless data communications system is used in a real-time basis.

9. The traffic information management system of claim 5, wherein the second wireless data communications system is used in a real-time basis.

10. The traffic information management system of claim 7, wherein the third wireless data communications system is used in a batch-wise basis.

11. The traffic information management system of claim 7, wherein the another data communications system is performed such that data is transported from the center to the in-vehicle terminal using a storage medium.

* * * * *